US006213842B1

(12) United States Patent
Degirmenci

(10) Patent No.: US 6,213,842 B1
(45) **Date of Patent: *Apr. 10, 2001**

(54) BRASSIERE FOR PROVIDING BREAST ENHANCEMENT

(76) Inventor: Julyet Degirmenci, 7 Willis Ave., Syosset, NY (US) 11791

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/169,728

(22) Filed: Oct. 9, 1998

(51) Int. Cl.[7] ..... A41C 3/00

(52) U.S. Cl. ..... 450/71; 450/73; 450/49; 450/59

(58) Field of Search ..... 450/49.59, 60–64, 450/71, 78, 73, 31, 30

(56) References Cited

U.S. PATENT DOCUMENTS 3,302,649 * 2/1967 Bruno ..... 450/71
3,595,243 7/1971 Mount .
4,413,625 11/1983 Footer .
4,530,361 * 7/1985 Wooten ..... 450/71
4,995,847 * 2/1991 Hwang ..... 450/71
5,098,330 3/1992 Greenberg .
5,119,511 6/1992 Packer et al. .

* cited by examiner

*Primary Examiner*—Gloria M. Hale
(74) *Attorney, Agent, or Firm*—Carmody & Torrance LLP

(57) ABSTRACT

A brassiere for providing breast enhancement. The brassiere includes a pair of spaced apart breast cups, with each of the cups including a support member that follows the curvature of at least the lower portion of the breast, an insert comprised of a front and rear panel forming at least one pocket and secured to the support member, and a band, disposed within the pocket, and secured to the edge of the cup and an end of the support member. The tension applied to the band causes a pulling effect on at least the front panel of the insert and the pulling effect of at least the front panel causes the respective breast to be inwardly drawn towards the connection region when the brassiere is secured to the user's chest.

12 Claims, 1 Drawing Sheet

BRASSIERE FOR PROVIDING BREAST ENHANCEMENT

BACKGROUND OF THE INVENTION

The present invention relates generally to brassieres and, in particular, to a brassiere which at least exerts forces on the wearer's breast moving them inwardly towards each other for improved breast enhancement. The preferred embodiment additionally provides for an upward lifting of the breasts.

Heretofore, many attempts have been made to construct a brassiere which provides for both lifting the breasts upwardly and inwardly towards each other for better breast enhancement.

For example, U.S. Pat. No. 5,098,330 describes the use of elastomeric members which when in use, create compressive forces upon the wearer's breasts which in combination with additional padding material, may tend to lift or push the breasts both upwardly and inwardly towards each other.

U.S. Pat. No. 3,595,243 describes an uplift brassiere which includes, within the inside tubular seams of the brassiere, a nonstretchable tension or pull element which passes around the underside of the breast cup such that when the side panels are stretched to tighten the brassiere about the user's body, the nonstretchable pull elements move along with the stretch of the side panels in effect to shorten the cup region and provide an elevation to the lower part of each breast cup. However, as would be well appreciated by one of skill in the art, the use of a nonstretchable tape or ribbon within the hollow seam of the cup requires a complicated and undesirable brassiere construction.

Lastly, U.S. Pat. No. 4,413,625 attempts to provide lateral and upward pulling action against the breasts by shortening the side panels of the brassiere itself.

These prior art constructions are undesirable because of their complicated construction and inability to achieve the desired breast enhancement, while at the same time, not fully appreciating the need to manufacture such a brassiere at a reasonable cost.

Accordingly, an improved brassiere construction that overcomes the aforementioned deficiencies and achieves the below mentioned objectives is desired.

SUMMARY OF THE INVENTION

Generally speaking, an improved brassiere for providing breast enhancement is provided. In a preferred embodiment, the brassiere includes securing means for securing the brassiere around the chest of a user and includes a pair of spaced apart breast cups, each cup for supporting at least a lower portion of a breast, the spaced apart breast cups being secured together at a connection region located at least essentially between the user's breasts. Each of the cups comprises a support member that follows the curvature of at least the lower portion of the breast, the support member having at least a first end secured to an edge of the cup, a second end secured to the connection region, and a middle portion intermediate the first and second end, an insert comprised of a front and rear panel forming at least one pocket, the insert being secured to the support member, and a band, disposed within the pocket, and having a first end secured to the edge of the cup and a second end secured to the second end of the support member. The tension applied to the band causes a pulling effect on at least the front panel of the insert and the pulling effect of at least the front panel causes the respective breast to be inwardly drawn towards the connection region when the brassiere is secured to the user's chest.

In an alternative embodiment, the brassiere includes a connector positioned essentially within the connection region, and the tension on the respective bands is adjustable so that the pulling effect of the respective front panels of the right and left inserts towards the connection region can be adjusted thereby at least inwardly adjusting the amount of desired breast enhancement.

In still a further embodiment, each insert includes a second pocket formed by the front and rear panels, wherein the tension applied to the band causes the pulling effect on at least the front panel of the insert forming the second pocket such that the pulling effect on at least the front panel of the second pocket causes the respective breast to be further inwardly drawn towards the connection region when the brassiere is secured to the user's chest. Yet further, a padding material may be placed in the second pockets for still further breast enhancement.

Still further, the bands may be tied together instead of providing a connector, such an embodiment being illustrated in the figures.

Accordingly, it is an object of the present invention to provide an improved brassiere construction that enhances the shape and look of a women's breast.

Another object of the present invention is to provide an improved brassiere construction that provides additional cleavage without the need for additional padding.

Yet another object of the present invention is to provide an improved brassiere construction that can provide breast enhancement in both a style that includes shoulder straps and a style that is strapless.

Still another object of the present invention is to provide an improved brassiere construction that can be employed in many different garments, such as swimsuits and evening gowns.

Yet another object of the present invention is to provide an improved brassiere construction that can be economically manufactured.

And still another object of the present invention is to provide an improved brassiere construction that permits a user to variably adjust the brassiere based on the amount of breast enhancement desired.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

DETAILED DESCRIPTION OF THE PREFERRED EMBODIMENTS

Figure 1:
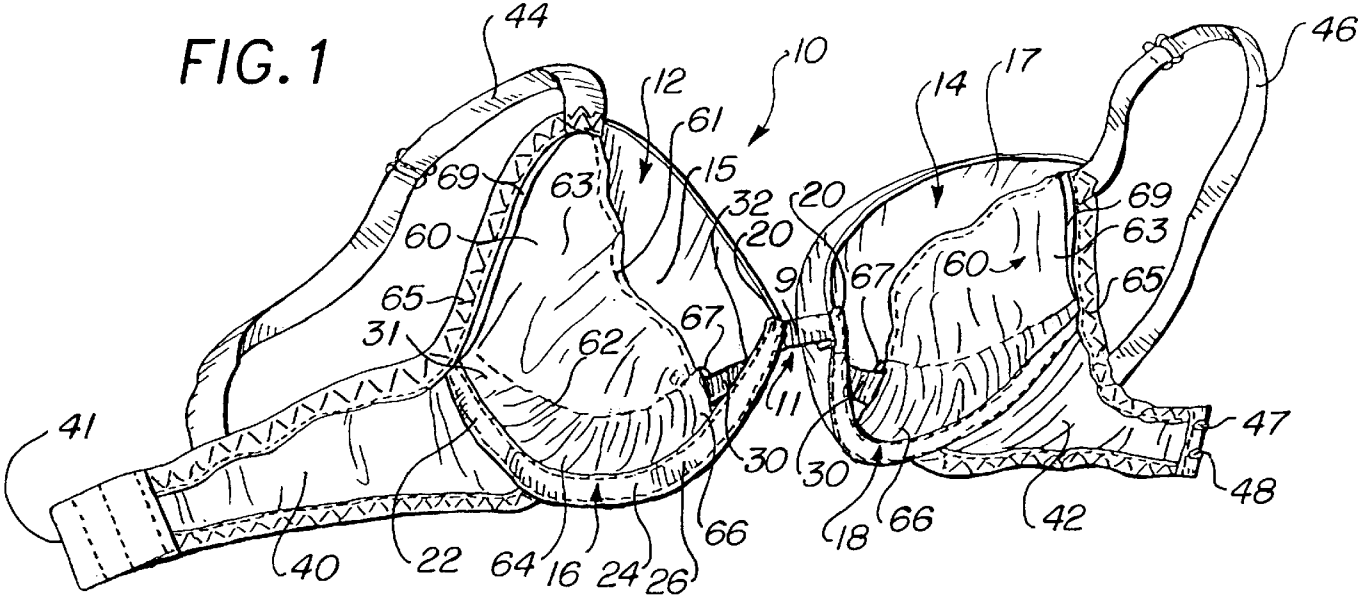
FIG. 1 is a perspective view of a brassiere constructed in accordance with the present invention.

Reference is first made to FIG. 1 which discloses a brassiere, generally indicated at 10, constructed in accordance with the present invention. Brassiere 10 includes a first cup, generally indicated at 12 and a second cup, generally indicated at 14 each of which, as would be understood in the art, include fabric layer(s) 15, 17 which would assume the general shape of a breast when worn by a user. The construction of these cups are well known in the art and fabric layer(s) 15, 17 may be made of any suitable fabric, such as silk or cotton, or a combination decorative outer piece of fabric and an inner piece of fabric as also would be well known in the art.

At the lower portion of each cup 12, 14 is a respective support member, generally indicated at 16, 18. Reference will hereinafter primarily be made to cup 12, with cup 14 being constructed in identical fashion. Support member 16 follows the curvature of at least the lower portion of a respective breast. Support member 16 includes a first end, generally indicated at 20, a second end generally indicated at 22 and a middle portion generally indicated at 24 between first end 20 and second 22. Support member 16 preferably includes an underwire which extends from first end 20 to second end 22 of support member 16. A fabric material 26, such as cotton or silk, is disposed over the underwire so as to provide comfort to the wearer. Fabric material 26 at second end 22 of support member 16 is secured, preferably by stitching, to an edge 65 that runs along the outer circumference of cup 12.

Cups 12 and 14 are connected together at a connector region 11, which is located on brassiere 10 at essentially between a wearer's breasts when brassiere 10 is being worn. Additional fabric material and/or stitching may be provided at the inner ends 20 of each support member 16, 18 so as to facilitate the securing together of cups 12, 14 by known stitching techniques. Cups 12 and 14 may be secured together at connection region 11 by a band 9 respectively stitched thereto.

Stitched to fabric 26 along at least a portion of support member 16 is an insert, generally indicated at 60. Insert 60 is preferably two-ply, having both a front panel 66 and a rear panel 67 stitched together along seams 61 and 62. In this manner, two interior pockets are formed, one pocket 63 and one pocket 64. The rear panel is preferably stitched to edge 65 of cup 12. Edge 65 may be a reinforced edge with additional stitching to maintain the integrity of cup 12. An opening 69 is formed between the front and rear panels along edge 65 for a padding material to be inserted into pocket 63. This padding material added to pocket 63 adds further lift to the respective breast as will be further discussed below.

In accordance with the invention, disposed within pocket 64 of each cup is a band, generally indicated at 30. Band 30 extends within pocket 64 and has one end 31 preferably stitched to the aforementioned edge 65 near end 22 of support member 16.

For appearance, end 31 of band 30 may be stitched to edge 65 in a manner that conceals end 31. That is, end 31 may be stitched to, or under, the reinforced edge 65 and therefore along an interior edge of cup 12. The front panel of insert 60 essentially covers end 31 so that brassiere 10 when constructed, is aesthetically pleasing and comfortable to the wearer.

A second end 32 of band 30 will preferably be stitched to fabric 26 at first end 20 of support member 16. However, end 32 may be stitched to the underside of fabric 26 behind the underwire and therefore to another interior edge of cup 12 so as to remain aesthetically pleasing and comfortable when brassiere 10 is fully constructed.

Pocket 64 may fully or at least essentially cover end 32 of band 30 in a similar manner that pocket 64 covers end 31 of band 30. This covering of end 32 provides both an aesthetic effect since brassiere 10 will look well constructed, and additionally, adds comfort to the wearer.

In accordance with the invention, end 32 is stitched near or to end 20 of support member 16 as disclosed above only after a sufficient tension has been placed on band 30 so as to create a "bunching" or pulling effect of the panel material that comprises insert 60. As should now be understood, if a tension is applied to band 30 by the pulling action at end 32, the front and back panels 66, 67 forming pocket 64 and/or pocket 63 are caused to also be pulled towards connection region 11. The "bunching" of the front panel 66 and back panel 67 is in part caused by the arcuately formed cups as well as the friction between the front and rear panels 66, 67 and the surface of band 30.

The amount of tension to be applied to band 30 in each cup is left up to the skilled brassiere designer, understanding that an increase in tension applied to band 30 causes an increase in the pulling effect of the front and back panels 66, 67 of insert 60. This identical effect is also seen in cup 14. The pulling effect of the material comprising insert 60 towards connector region 11 will cause the respective breast to be pulled upwardly and inwardly towards the center of the wearer's chest. Therefore, the more tension applied to band 30 in each cup 12, 14, the more the breasts will move towards each other when brassiere 10 is worn.

Accordingly, end 32 of each band 30 in each respective cup 12, 14 is stitched (or secured with equivalent means) to each respective end 20 of support member 16, 18 after it has been determined how much tension is desired. This determination can be based on, for example, experimental data. That is, different amount of tension applied to each band 30 can provide for different amounts of breast enhancement. Accordingly, different styles of brassieres having differing amounts of breast enhancement are achievable.

Band 30 may be formed of a variety of materials, such as a ribbon or a stretchable fabric. Band 30 may be elastic or non-elastic. That is, it is the pulling effect on insert 60 of cup 12 (a similar effect taking place on insert 60 of cup 14) that provides the inwardly and upwardly directed force upon the breasts due to the gathering of the panel material, thereby providing the breast enhanced appearance.

Brassiere 10 also includes a pair of side panels 40, 42 which are respectively secured to cups 12 and 14 along a portion of the respective support members in a well known manner. A shoulder strap 44 is stitched to cup 12 and side panel 40 and a shoulder strap 46 is also provided and stitched to cup 14 and side panel 42 all being done in accordance with known methodologies. It should be understood that the present invention is also applicable when incorporated in a strapless brassiere. Such a modification is well within the scope of the present invention as it should now be understood that the tension on the respective bands 30 and the gathering of the front and rear panels of each respective insert 60 in each cup causes the breasts to be drawn inwardly and upwardly.

Also, as would be known in the art, fastening elements 47, 48 engage complementary fastening receivers (not shown) on an end 41 of side panel 40.

In use, with brassiere 10 secured to the wearer's body, the gathering of the inserts 60 towards the center of the brassiere causes the respective breasts, once inserted therein, to be drawn towards each other. The drawing in of each respective breast towards connection region 11 provides for an enhanced breast appearance as the respective breasts are drawn both inwardly and upwardly.

Figure 2:
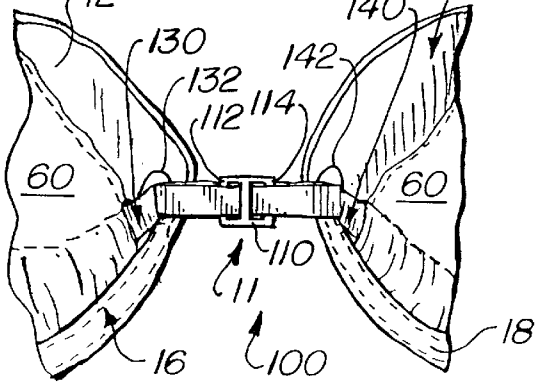
FIG. 2 is a plan view of a portion of a brassiere constructed in accordance with a second embodiment of the present invention, with the features not shown therein being identical to those of the brassiere illustrated in FIG. 1.

Reference is now made to FIG. 2 which depicts a portion of a brassiere 100, constructed in accordance with an alternative embodiment of the present invention. Those features and structure not shown in FIG. 2 should be understood to be incorporated into brassiere 100 but have been intentionally omitted in the drawing for simplicity. Reference numerals referenced with respect to brassiere 100 which are not illustrated in FIG. 2 are deemed to identify identical structure as that in brassiere 10.

Generally speaking, brassiere 100 will also include side panels or the like to assist in securing the brassiere around the chest of a user, and may or may not include shoulder straps. Brassiere 100 also includes spaced apart right and left breast cups, generally indicated at 12, 14, each cup for supporting at least a lower portion of a respective breast. Likewise, the right and left breast cups are connected together at a connection region 11 located at least essentially between the user's breasts. Each cup 12, 14 includes an insert constructed in a similar manner as insert 60 discussed above.

Figure 3:
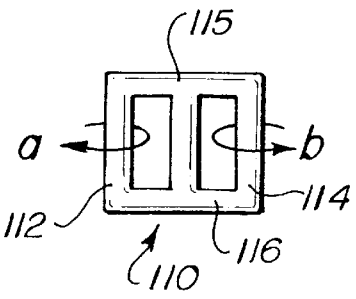
FIG. 3 is an exemplary construction of a connector used with the brassiere illustrated in FIG. 2.

In the alternative embodiment of FIG. 2, a connector 110, shown enlarged in FIG. 3, is positioned essentially within connection region 11 and attached thereto so as to be preferably hidden from view when viewing brassiere 100 as it is being worn by a user. However, connector 110 is shown slightly enlarged in FIG. 2 for ease of illustration. Connector 110, which may be a integrally formed plastic member, may be in the shape of a rectangle with side bars 112, 114, a top bar 115 and a bottom bar 116. Alternative constructions of connector 110, keeping in mind the following objective, is well within the scope of the skilled artisan.

As implied above, the right and left cups of brassiere 100 are constructed similarly to the cups of brassiere 10. Moreover a first end of a band, indicated generally as 130 and corresponding to band 30, has a first end attached to cup 12 in a similar manner as end 31 is attached to edge 65 in brassiere 10. The modification in brassiere 100 is that an end 132 of band 130 in cup 12 is adjustably secured about side bar 112. That is, end 132 may be looped around side bar 112 and attached onto itself by known securing means, such as Velcro®, it being understood that Velcro® is but one example of a means to secure end 132 about side bar 112. Such looping around is indicated by arrow "a" in FIG. 3. In a similar fashion, the band disposed in cup 14 of brassiere 100, hereinafter generally indicated by 140, is similarly secured to the respective edge 65 of cup 14 and similarly looped about side bar 114 of connector 110 as indicated by arrow "b." It should be understood that the respective ends of bands 130, 140 which are adjustably secured to respective side bars 112, 114 can be individually adjusted, so that the pulling force by the respective bands 130 and 140 adjustably, and at least inwardly, draws (i.e. "bunches" or gathers) the fabric panels comprising the inserts in each cup towards the center of brassiere 100, i.e. towards connector region 11. This in turn will cause the inwardly drawing of each respective breast towards connection region 11 when the brassiere is placed upon the wearer's chest. The use of the Velcro® or suitable substitute on the surface of the respective ends 132 and 142 of bands 130, 140 maintains the tension on bands 130, 140.

It will thus be seen that the objects set forth above, including the providing of an improved brassiere construction that enhances the appearance of a woman's breasts as they are drawn inwardly and upwardly are efficiently attained. Moreover, since certain changes may be made in the above constructions without departing from the spirit and scope of the invention, it is intended that all matter contained in the above description or shown in the accompanying drawings shall be interpreted as illustrative and not in a limiting sense.

Moreover, the above constructions provide for an even further breast enhanced appearance. For example, as will be recalled, the stitching together of the front and rear panels 66, 67 comprising insert 60 of each cup 12, 14 provide respective pockets 63. As a slit is also provided between the front and rear panels of insert 60 along edge 65, the insertion and removal of a padding material, such as silicon, foam or the like is hereby possible. Additionally or alternatively, pockets can be incorporated into the cups themselves in a known manner for still additional breast enhancement. That is, fabric 15 and 17 would comprise at least two layers so that additional padding can be inserted therebetween.

It should be understood that the inclusion of both pockets 63 and 64 will provide increased breast enhancement over an embodiment having only one pocket 64, although the present invention, as recited in the claims, is directed to both embodiments, that is, one embodiment having one pocket 64 as well as an embodiment having both pockets 63 and 64.

Figure 4:
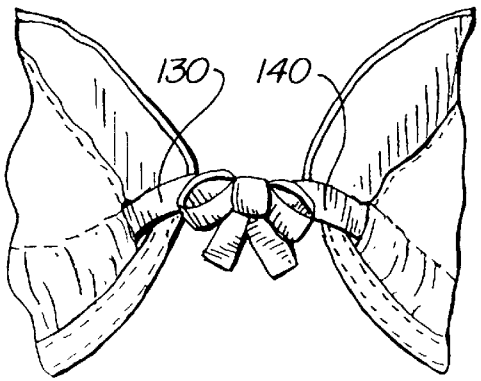
FIG. 4 is a plan view of a portion of a brassiere constructed in accordance with yet a third embodiment of the present invention, the construction being identical to the embodiment shown in FIG. 2 with the exception that the bands are tied together instead of utilizing a connector.

Additionally, FIG. 4, which is identical in almost all respects to the embodiment depicted in FIG. 2, is illustrated to show yet a further embodiment of the present invention in which the ends of bands 130 and 140 in each cup may be tied together to achieve the functionality provided by connector 110.

It is also to be understood that the following claims are intended to cover all of the generic and specific features of the invention described herein and all statements of the scope of the invention which as a matter of language might fall therebetween.

I claim:

1. A brassiere for providing breast enhancement, the brassiere comprising side members for securing the brassiere around the chest of a user and a pair of spaced apart breast cups, each cup for supporting at least a lower portion of a breast, the spaced apart breast cups being secured together at a connection region located at least essentially between the user's breasts, each of the cups comprising:

a support member that follows the curvature of at least the lower portion of the breast, the support member having at least a first end secured to an edge of the cup, a second end secured to the connection region, and a middle portion intermediate the first and second end;

an insert comprised of a front and rear panel forming at least one pocket, the insert being secured to the support member;

a band, disposed within the pocket, and having a first end secured to the edge of the cup and a second end secured to the second end of the support member;

wherein tension applied to the band causes the gathering of at least the front panel of the insert;

whereby the pulling effect of at least the front panel causes the respective breast to be inwardly drawn towards the connection region when the brassiere is secured to the user's chest.

2. The brassiere as claimed in claim 1, wherein the support member of each cup includes an underwire encapsulated by a fabric material.

3. The brassiere as claimed in claim 1, wherein the insert of each cup further includes a second pocket formed by the front and rear panel, wherein the tension applied to the band causes the gathering of at least the front panel of the insert forming the second pocket;

whereby the gathering of at least the front panel of the second pocket causes the respective breast to be further inwardly drawn towards the connection region when the brassiere is secured to the user's chest.

4. The brassiere as claimed in claim 3, including a padding material disposed within the second pocket;

whereby the padding material provides an upward force upon the respective breast.

5. A brassiere for providing breast enhancement, the brassiere comprising;

side members for securing the brassiere around the chest of a user;

spaced apart right and left breast cups, each cup for supporting at least a lower portion of a respective breast, the right and left breast cups being connected together at a connection region located at least essentially between the user's breasts;

wherein the right cup comprises a right support member that follows the curvature of at least the lower portion of the right breast, the right support member having at least a first end secured to an edge of the right cup, a second end secured to the connection region, and a middle portion intermediate the first and second end; a right insert comprised of a front and rear panel forming at least one pocket, the right insert being secured to the right support member; a right band, disposed within the pocket, and having a first end secured to the edge of the right cup and a second end adjustably coupled to a left band;

wherein the left cup comprises a left support member that follows the curvature of at least the lower portion of the left breast, the left support member having at least a first end secured to an edge of the left cup, a second end secured to the connection region, and a middle portion intermediate the first and second end; a left insert comprised of a front and rear panel forming at least one pocket, the left insert being secured to the left support member; a left band, disposed within the pocket, and having a first end secured to the edge of the left cup and a second end adjustably coupled to the second end of the right band;

wherein adjusting tension on the right band and the left band adjustably and at least inwardly draws the at least respective front panels of the right and left inserts towards the connection region thereby at least inwardly drawing each respective breast towards the connection region when the brassiere is secured to the user's chest.

6. The brassiere as claimed in claim 5, including a connector positioned essentially within the connection region, the connector having at least a first bar and a second bar;

wherein the second end of the right band is adjustably securable about the first bar and the second end of the left band is adjustably securable about the second bar; and means for maintaining the tension on the right and left bands.

7. The brassiere as claimed in claim 5, wherein the second end of the right band is adjustably coupled to the second end of the left band by the releasable knotting of the respective second ends of the right and left bands.

8. The brassiere as claimed in claim 6, wherein the connector includes a body portion and the first and second bars are integrally formed therewith;

wherein the second end of the right band is threaded about the first bar and is secured to a portion of the right band and wherein the second end of the left band is threaded about the second bar and is secured to a portion of the left band;

whereby the securing of the respective ends of the respective right and left bands respectively thereto maintains the desired tension of the respective bands.

9. The brassiere as claimed in claim 5, wherein the insert of each cup further includes a second pocket formed by the front and rear panel, wherein the tension applied to the band in each cup causes a pulling effect on at least the front panel of the insert in each cup forming the second pocket;

whereby the pulling effect of at least the front panel of the second pocket in each cup towards the connection region causes the respective breast to be further inwardly drawn towards the connection region when the brassiere is secured to the user's chest.

10. The brassiere as claimed in claim 9, including a padding material disposed within the second pocket;

whereby the padding material provides an upward force upon the respective breast.

11. The brassiere as claimed in claim 6, wherein the connector is connected to the connection region.

12. A brassiere for providing breast enhancement, the brassiere comprising side members for securing the brassiere around the chest of a user and a pair of spaced apart breast cups, each cup for supporting at least a lower portion of a breast, the spaced apart breast cups being secured together at a connection region located at least essentially between the user's breasts, each of the cups comprising:

a support member that follows the curvature of at least the lower portion of the breast, the support member having at least a first end secured to an edge of the cup, a second end secured to the connection region, and a middle portion intermediate the first and second end;

a band, disposed across a lower portion of the cup, and having a first end secured to the edge of the cup and a second end secured to the second end of the support member; wherein the force of the band upon a lower portion of the respective breast causes the respective breast to be inwardly and upwardly directed when the brassiere is secured to the user's chest.

* * * * *